US011268792B2

(12) United States Patent
O'Reilly

(10) Patent No.: US 11,268,792 B2
(45) Date of Patent: Mar. 8, 2022

(54) MODULAR TRAY SYSTEM FOR COUNTING AND/OR STORING AMMUNITION COMPONENTS

(71) Applicant: John M. O'Reilly, Littleton, CO (US)

(72) Inventor: John M. O'Reilly, Littleton, CO (US)

( * ) Notice: Subject to any disclaimer, the term of this patent is extended or adjusted under 35 U.S.C. 154(b) by 87 days.

(21) Appl. No.: 16/590,344

(22) Filed: Oct. 1, 2019

(65) Prior Publication Data

US 2021/0095943 A1 Apr. 1, 2021

(51) Int. Cl.
*F42B 39/26* (2006.01)
*B65B 5/08* (2006.01)

(52) U.S. Cl.
CPC ..... *F42B 39/26* (2013.01); *B65B 5/08* (2013.01)

(58) Field of Classification Search
CPC ..... B65B 5/08; B65B 35/14; B65D 21/0224; B65D 21/0226; F42B 33/002; F42B 39/26
USPC ..... 206/3
See application file for complete search history.

(56) References Cited

U.S. PATENT DOCUMENTS

| | | | | |
|---|---|---|---|---|
| 4,027,417 | A | 6/1977 | Swatek | |
| 4,811,836 | A * | 3/1989 | Minneman | F42B 39/26 206/3 |
| 5,052,549 | A * | 10/1991 | Scharch | F42B 39/00 206/3 |
| 7,395,922 | B1 * | 7/2008 | Sinha | F42B 39/26 206/3 |
| 9,038,817 | B2 | 5/2015 | Connolly | |
| 9,726,468 | B2 | 8/2017 | Boyd | |
| 2012/0321431 | A1 * | 12/2012 | Riedesel | F42B 39/26 414/802 |
| 2020/0109930 | A1 * | 4/2020 | Lutz | F42B 39/26 |

* cited by examiner

*Primary Examiner* — Ernesto A Grano
*Assistant Examiner* — Elisabeth Sullivan
(74) *Attorney, Agent, or Firm* — Leyendecker & Lemire, LLC

(57) ABSTRACT

A modular tray system for counting and/or storing ammunition components is described. Embodiments of the modular tray system can include, but are not limited to, a base tray, one or more spacers, one or more adapter trays, and a cover. The one or more spacers and the one or more adapter trays can each be configured to operate in combination with the base tray. The cover can be configured to be placed over outer edges of the base tray.

19 Claims, 9 Drawing Sheets

MODULAR TRAY SYSTEM FOR COUNTING AND/OR STORING AMMUNITION COMPONENTS

BACKGROUND

Reloading (or handloading) ammunition for firearms includes the process of loading firearm cartridges or shotgun shells by assembling individual components that make up the ammunition. Counting out the components is often time-consuming when reloading large batches (>50) of ammunition. Typically, an individual will count out each batch singularly so that they know exactly how many components they will need. This can include counting each ammunition component out so that there are enough of each ammunition component for every one being reloaded. Ammunition components can include cases, projectiles, propellants, and primers. Besides the propellant, each component would have to be individually counted to ensure there are enough. This can include counting out large batches of each component which can be very time consuming.

A device or system that can accurately and efficiently count and sort ammunition components is needed.

DETAILED DESCRIPTION

Figure 1:
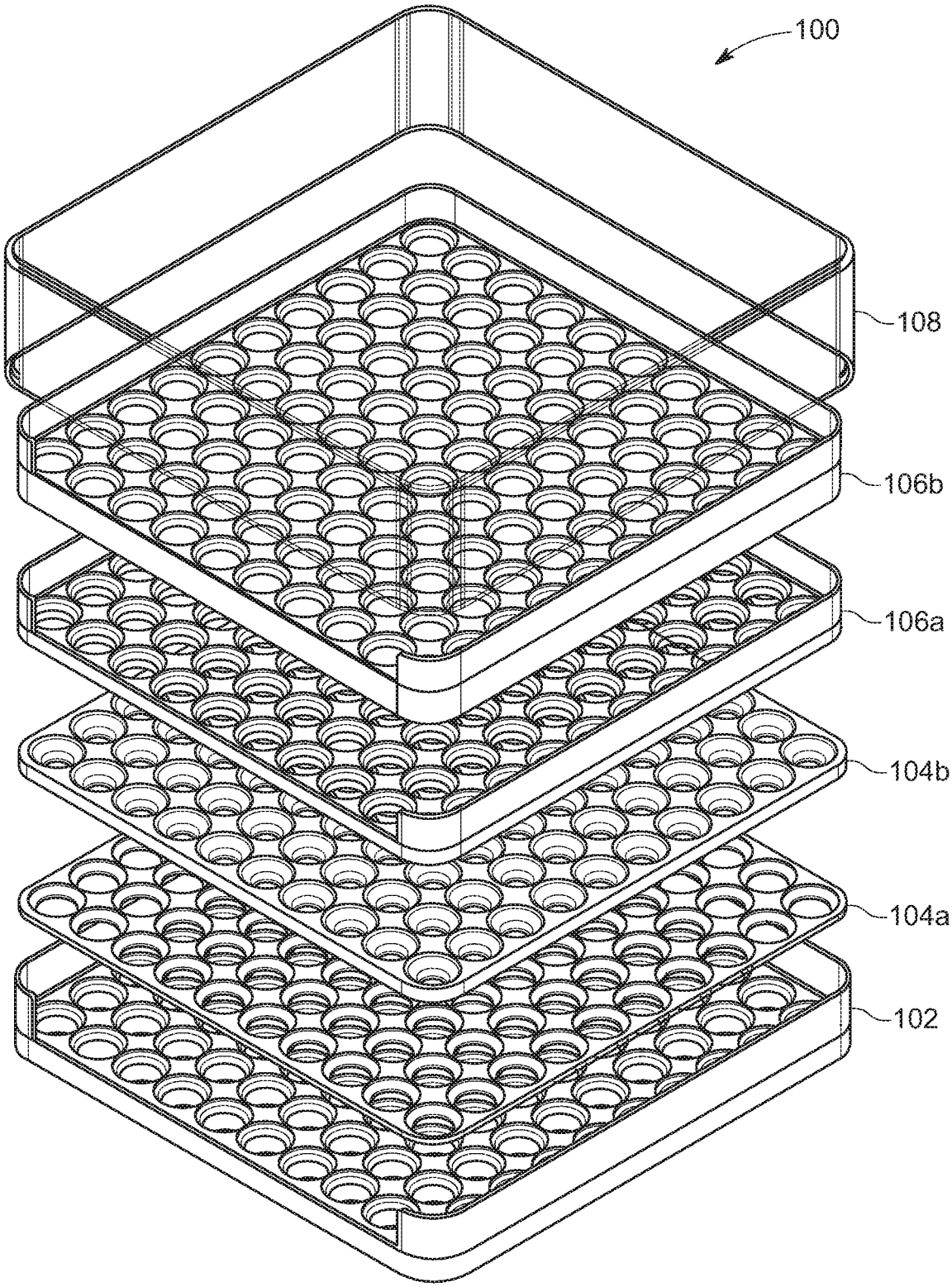
FIG. 1 is an exploded view of a modular tray system according to one embodiment of the present invention.

Embodiments of the present invention include a modular tray system for counting and/or storing ammunition components. Typically, the modular tray system can be implemented with cartridge components (e.g., cases, projectiles, etc.) for firearms. In one embodiment, the modular tray system can include, but is not limited to, a base tray, one or more adapter trays, one or more spacers, a cover, and a baffle. Embodiments are contemplated wherein one or more of the above-mentioned components are used in combination with the base tray.

The modular tray system can be implemented to count cartridge components (e.g., casings, projectiles, etc.) for reloading ammunition for firearms. It is to be appreciated that other objects, items, and components may be counted and sorted with the modular tray system and the described embodiments are not meant to be limited to ammunition components.

In one embodiment, the base tray can be defined by a substantially square shape. The base tray can include sidewalls that extend up and above a top surface on three sides of the tray. The base tray can further include a grid of holes that are configured to receive an ammunition component therein. Typically, a top portion of each of the holes can be beveled (or tapered) down and in towards a rest of the hole. The beveled opening can induce ammunition components to fall into an open hole. When an ammunition component is inserted, or falls, into a hole, a top of the ammunition component can be approximately level with a top of the hole. Of note, when another ammunition component passes a filled hole, the ammunition component may keep moving until it finds an open hole. As can be appreciated, the ammunition component already in a hole will prevent another ammunition component from entering said hole. In one example embodiment, the grid of holes can be a 10×10 grid, to include a total of 100 holes. It is to be appreciated that other sized grids can be implemented.

The one or more adapter trays can be constructed substantially similar to the base tray. The adapter trays can be sized to fit within the sidewalls of the base tray. A grid of holes of an adapter tray can be configured to align with the grid of holes of the base tray when the adapter tray is placed on and within the sidewalls of the base tray. The adapter trays can each include sidewalls on three sides of the tray. Of note, the grid of holes of the adapter trays can pass through a top surface and a bottom surface of the adapter tray such that a component could pass entirely through the hole.

The one or more spacers can have a substantially square shape with a grid of holes configured to match the grid of holes from the base tray. The spacers can be implemented to increase a height of the holes such that longer ammunition components can be counted and/or stored. The spacers can be sized to fit within the sidewalls of the base tray. Similar to the adapter trays, the holes of the one or more spacers can pass through a top surface and a bottom surface of the spacer.

The cover can be implemented to interface with the base tray and encase any ammunition components being stored in the base tray. In one embodiment, the cover can be manufactured from a substantially translucent material so that a user may see what is in the base tray. Generally, each of the components of the modular tray system can be stored within the base tray and the cover. As can be appreciated, by storing each of the components in the modular tray system, a footprint of the system can be minimized.

The baffle can be a hand-held tool configured to act as a fourth sidewall for the trays. The baffle can include a handle and a substantially rectangular plate having a width that is slightly less than a width of the base tray. The baffle can be sized to fit within the adapter trays as well. In a typical use, the baffle can be implemented to cover an open side of the base tray and span across an entire width of the grid. A user can move the baffle forward to effectively reduce a size of the tray for purposes of counting ammunition components. For instance, the baffle can be moved forward row by row of the grid to reduce the number of holes. In one example, if the grid of holes is a 10×10 grid, a user can reduce the number of holes by 10 by moving the baffle row by row. In such an instance, a user may want to count only 50 ammunition components instead of 100. By using the baffle, the user can quickly limit the grid to 50 holes for quick counting.

In a typical implementation of the modular tray system, a user can first determine a size of the ammunition component to be counted. Depending on the size of ammunition components, the base tray can be implemented by itself or one or more of the adapter trays and spacers can be implemented in combination with the base tray. The user can then pour a plethora of the ammunition components into the base tray (or combination of base tray and spacers and/or adapter trays). The user may then tilt the base tray in different directions so as to roll the components around the grid of holes. As the components roll around the grid of holes, the components can fall into the holes. Of note, the depth of each hole, which can be adjusted by implementing one or more of the adapter trays and spacers, allows for the components to fall into the hole and not protrude above a top of the hole while preventing another component from getting stuck in the component filled hole. Loose components may then freely travel across the tray to find an open hole until all of the holes are filled or all the components have found a hole. After all of holes are filled, the user can expel any extra components. Once all the holes are filled, the user can know exactly how many components have been counted by a visual confirmation that every hole is filled with a component.

In one embodiment, the modular tray system can be implemented as a reloading tray. Cases that have been processed for reloading can be set into the holes of the tray to be held upright. The cover can be implemented as a dust cover to provide protection to cases that have been filled with gunpowder but have not yet been pressed with a projectile. As can be appreciated, the cover can keep dust and other particulates from entering the cases and contaminating the gunpowder.

Embodiments of the modular tray system can provide several advantages over currently available devices. By implementing the modular tray system, most bullet projectiles can be counted in approximately 5 seconds or less. Brass casings, which are typically more angular and squarer in shape, can be counted in 10 seconds or less. The modular tray system can provide almost instantaneous visual confirmation of a number of ammunition components loaded into the tray system. The modularity of the tray system allows for a variety of differently sized calibers of ammunition. The sidewalls of the trays allow for easy containment of ammunition components that are loose on the tray. The various adapter trays and spacers can allow for holes having a depth of approximately ⅜" to 1".

Terminology

The terms and phrases as indicated in quotation marks (“ ”) in this section are intended to have the meaning ascribed to them in this Terminology section applied to them throughout this document, including in the claims, unless clearly indicated otherwise in context. Further, as applicable, the stated definitions are to apply, regardless of the word or phrase's case, to the singular and plural variations of the defined word or phrase.

The term “or” as used in this specification and the appended claims is not meant to be exclusive; rather the term is inclusive, meaning either or both.

References in the specification to “one embodiment”, “an embodiment”, “another embodiment, “a preferred embodiment”, “an alternative embodiment”, “one variation”, “a variation” and similar phrases mean that a particular feature, structure, or characteristic described in connection with the embodiment or variation, is included in at least an embodiment or variation of the invention. The phrase “in one embodiment”, “in one variation” or similar phrases, as used in various places in the specification, are not necessarily meant to refer to the same embodiment or the same variation.

The term “couple” or “coupled” as used in this specification and appended claims refers to an indirect or direct physical connection between the identified elements, components, or objects. Often the manner of the coupling will be related specifically to the manner in which the two coupled elements interact.

The term “directly coupled” or “coupled directly,” as used in this specification and appended claims, refers to a physical connection between identified elements, components, or objects, in which no other element, component, or object resides between those identified as being directly coupled.

The term “approximately,” as used in this specification and appended claims, refers to plus or minus 10% of the value given.

The term “about,” as used in this specification and appended claims, refers to plus or minus 20% of the value given.

The terms “generally” and “substantially,” as used in this specification and appended claims, mean mostly, or for the most part.

Directional and/or relationary terms such as, but not limited to, left, right, nadir, apex, top, bottom, vertical, horizontal, back, front and lateral are relative to each other and are dependent on the specific orientation of a applicable element or article, and are used accordingly to aid in the description of the various embodiments and are not necessarily intended to be construed as limiting.

The terms “case” and “casing,” as used in this specification and appended claims, refer to the same thing and can be used interchangeably.

An Embodiment of a Modular Tray System

Referring to FIG. 1, an exploded view of an embodiment 100 of a modular tray system is illustrated. The modular tray system 100 can be implemented to count and/or store ammunition components. Ammunition including a cartridge can typically be implemented with the modular tray system 100. A cartridge can include a case, a bullet (or projectile), propellant, and a primer. A rim can typically be manufactured as an integral part of the case. The case can contain the propellant, the bullet, and the primer. When the components are assembled together, a cartridge can be made.

Figure 7:
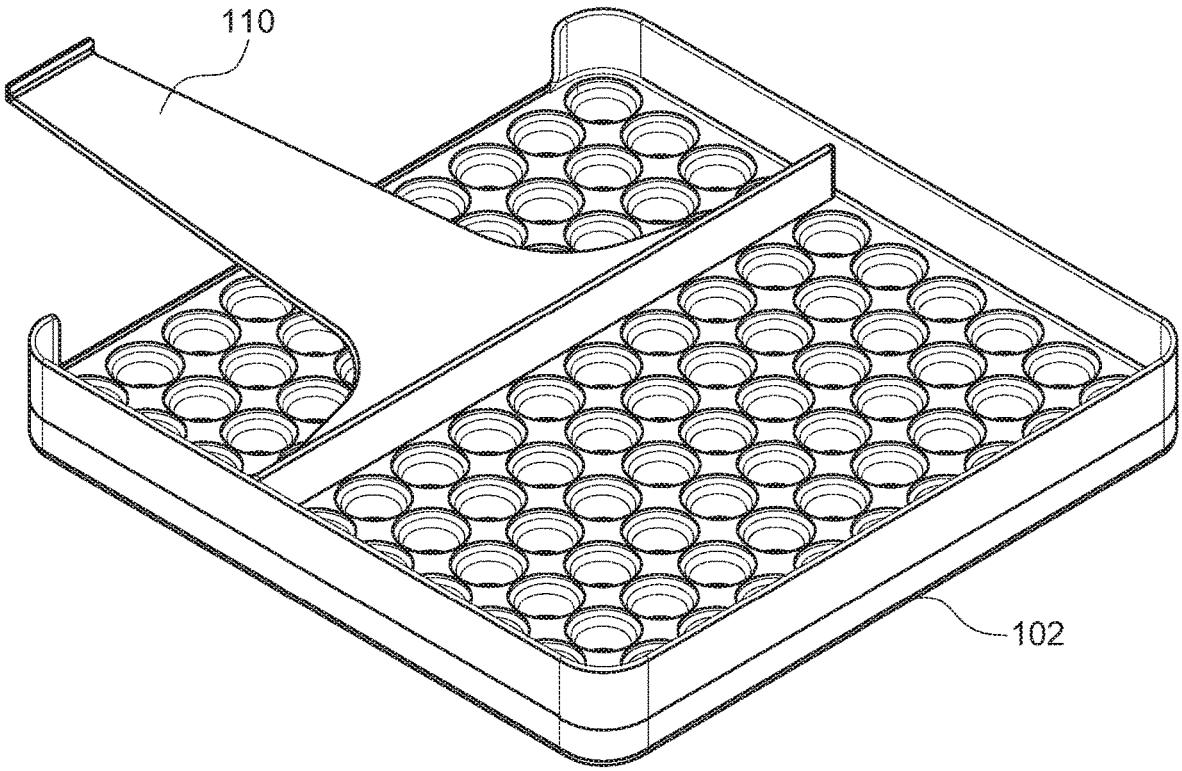
FIG. 7 is a side, perspective view of a base tray and a baffle according to one embodiment of the present invention.

As shown in FIG. 1, the modular tray system 100 can include, but is not limited to, a first tray 102, a first spacer 104*a*, a second spacer 104*b*, a first adapter tray 106*a*, a second adapter tray 106*b*, and a cover 108. The modular tray system 100 may further include a baffle 110 as shown in FIG. 7. The first tray 102 may be implemented as a base tray 102 from which the other components can be added. The modular tray system 100 can include a plurality of receptacles for receiving ammunition components (or other objects) to be counted. The plurality of receptacles can be defined by grids of holes of the components hereinafter described in detail. For instance, a grid of holes of the base tray 102 may define the plurality of receptacles in one implementation. In another instance, a grid of holes of the base tray 102 in combination with a grid of holes of the first spacer 104*a* may define the plurality of receptacles. As can be appreciated, when components are used in conjunction, a depth of the plurality of receptacles can be altered to work with different sized ammunition components.

The first spacer 104*a* and the second spacer 104*b* are illustrated, but embodiments are contemplated where more spacers can be implemented. Similarly, the first adapter tray 106*a* and the second adapter tray 106*b* are illustrated, but embodiments are contemplated where more adapter trays can be implemented. The spacers 104*a*, 104*b* and the adapter trays 106*a*, 106*b* can be sized to fit within sidewalls of the base tray 102. Of note, a combination of the spacers 104*a*, 104*b* and the adapter trays 106*a*, 106*b* can be implemented depending on a size of components being sorted and counted.

Figure 2A:
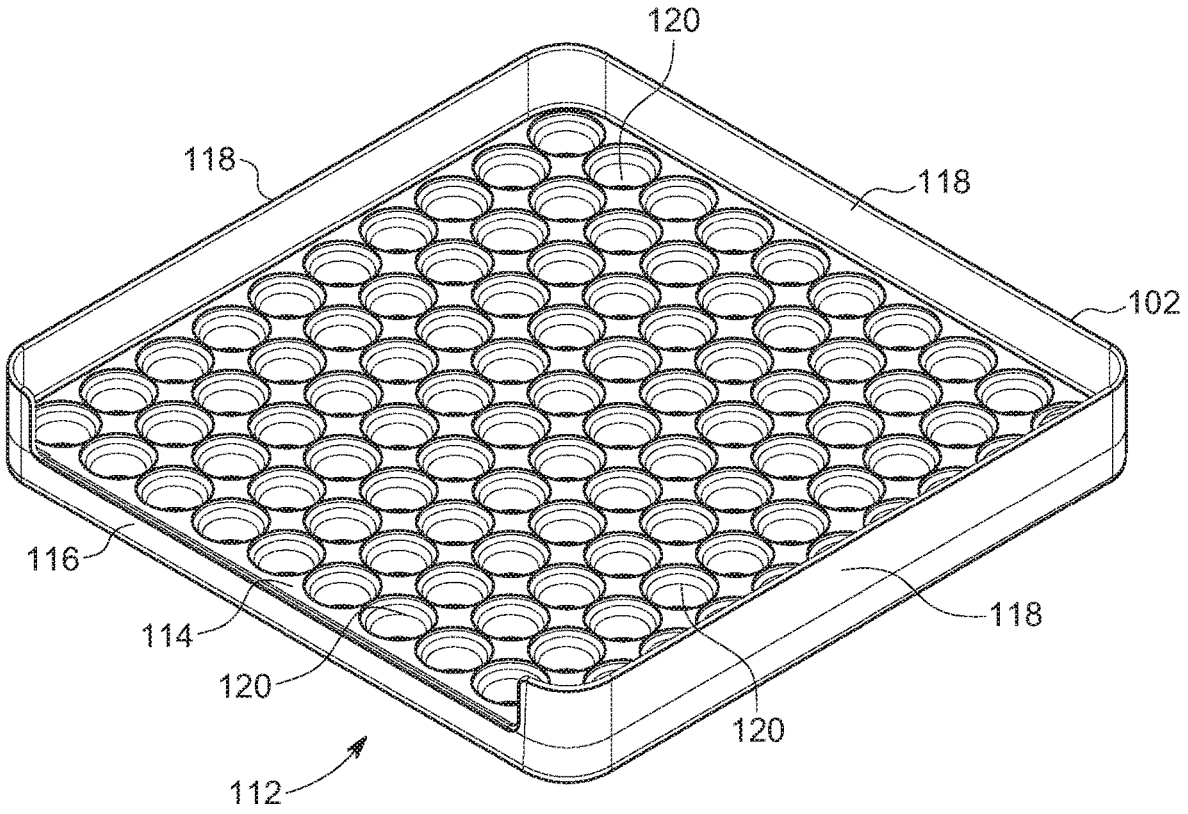
FIG. 2A is a front perspective view of a base tray according to one embodiment of the present invention.
Figure 2B:
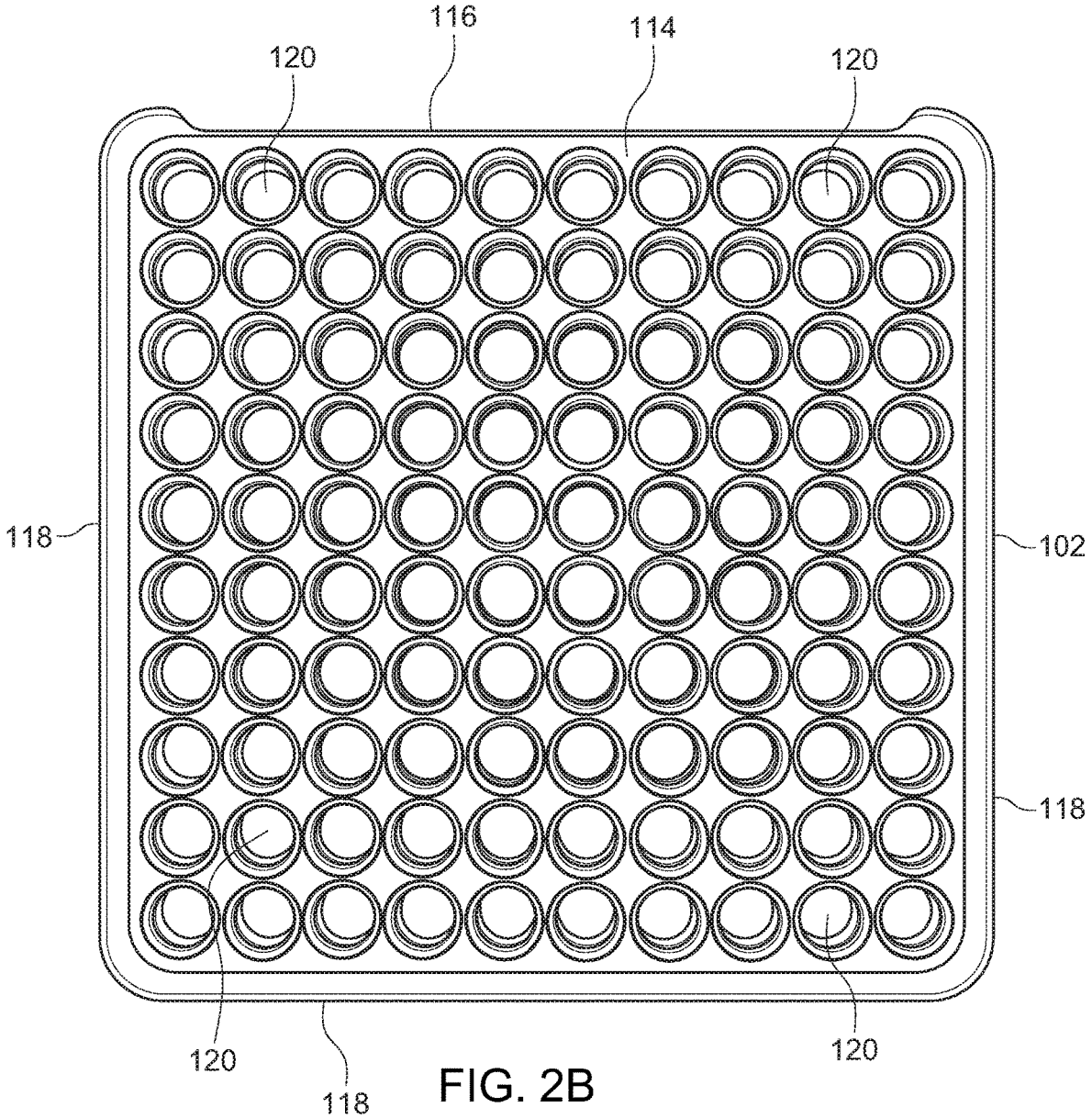
FIG. 2B is a top view of a base tray according to one embodiment of the present invention.

Referring to FIG. 2A, a perspective view of the base tray 102 is illustrated. Referring to FIG. 2B, a top view of the base tray 102 is illustrated. As shown, the base tray 102 can have a substantially square shape. It is to be appreciated that other shapes are contemplated and do not exceed a scope of the present invention. The base tray 102 can be defined by a bottom surface 112, a top surface 114, a first sidewall 116, and a plurality of second sidewalls 118. The first sidewall 116 can typically extend between the bottom surface 112 and the top surface 114. The plurality of second sidewalls 118 can extend above the top surface 114 a predetermined distance, as shown in FIG. 2A. In one example embodiment, the sidewalls 118 can extend approximately ⅝" above the top surface 114.

The base tray 102 can include a plurality of holes 120. A depth of the plurality of holes 120 can be defined by a distance between the bottom surface 112 and the top surface 114. In one example embodiment, the depth of each of the plurality of holes 120 can be approximately ⅜". A distance from the top surface 114 to a bottom of the bottom surface 112 can be approximately 7⁄16". Of note, the bottom surface 112 can stop components deposited into the holes 120 from exiting the base tray 102 from the bottom. In instances where the base tray 102 may be implemented by itself to count ammunition components, the grid of holes 120 may define the plurality of receptacles for receiving the ammunition components.

In one embodiment, the plurality of holes 120 can be oriented into a grid. Of note, the number of holes 120 can be increased or decreased without exceeding a scope of the present invention. In one example, as shown in FIGS. 2A-2B, the grid can be a 10×10 grid with 100 holes. The plurality of holes 120 can each have a beveled (or tapered or filleted) opening wherein a diameter of a top portion of each hole can be greater than a diameter of the rest of the hole. For instance, the opening of the top portion of the holes 120 can taper to a consistent interior diameter. The openings of the holes 120 can be beveled such that a component being counted can be induced by the bevel to drop into the hole by the sloped opening. Of note, the bevel (or taper or fillet) may have a rounded, curved, squared, radiused, or faceted surface.

As shown, the base tray 102 can have a substantially square shape with rounded edges. The rounded edges of the base tray 102 can be implemented to encourage components to move while the base tray 102 is moved by a user. Typically, the sidewalls 118 proximate the open side of the base tray 102 can extend partially into the open side. This can allow for components that are proximate those two corners to stay inside the base tray 102 in lieu of exiting the base tray 102 via the open side.

Figure 3:
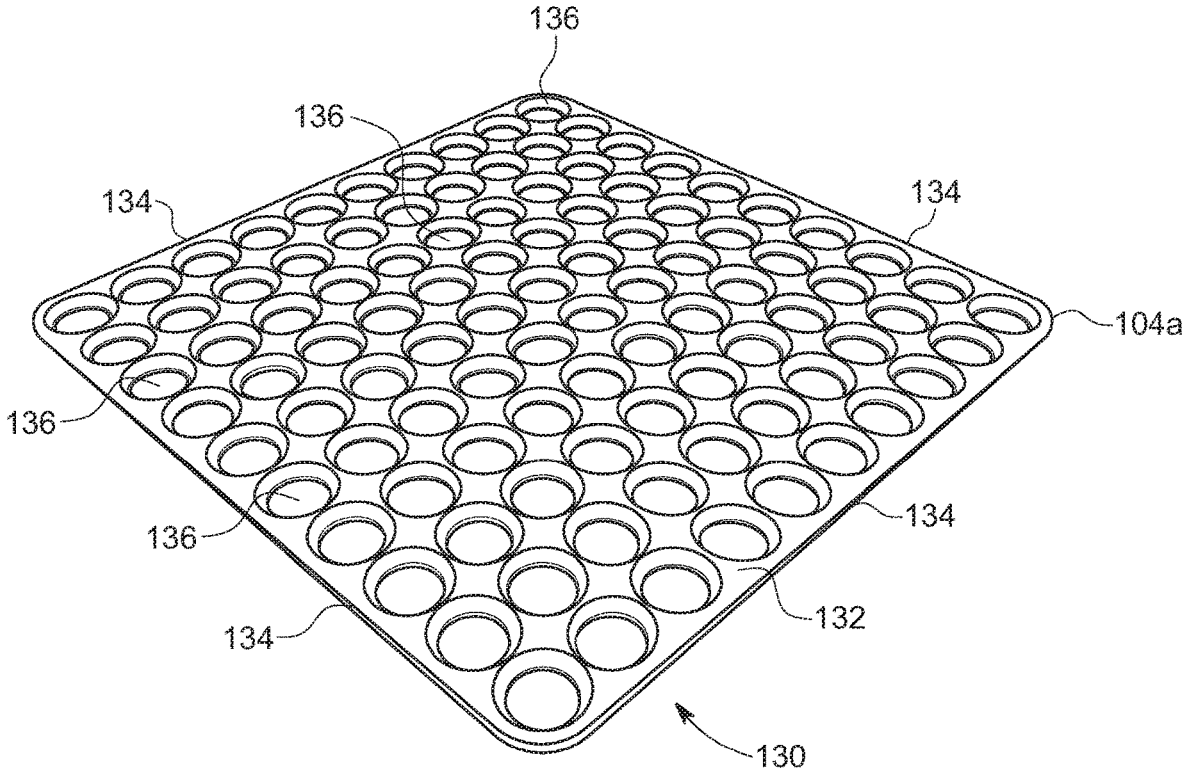
FIG. 3 is a front, perspective view of a spacer according to one embodiment of the present invention.

Referring to FIG. 3, a perspective view of the first spacer 104*a* is illustrated. The first spacer 104*a* can be sized to fit within the sidewalls 118 of the base tray 102 and on top of the top surface 114. As shown, the first spacer 104*a* can have a substantially square shape and can include a bottom surface 130, a top surface 132, and four sidewalls 134. The first spacer 104*a* can further include a grid of holes 136. The grid of holes 136 can extend through the top surface 132 and the bottom surface 130 of the first spacer 104*a*. Typically, the opening of each of the holes on the top surface 132 can be beveled similar to the base tray grid of holes 120. The first spacer grid of holes 136 can be configured to align with the base tray grid of holes 120. A depth of the first spacer grid of holes 136 can be defined by a distance between the bottom surface 130 and the top surface 132 of the first spacer 104*a*. Generally, a height of the sidewalls 134 can be approximately equal to the depth of the first spacer grid of holes 136.

When the first spacer 104*a* may be used in combination with the base tray 102, the first spacer grid of holes 136 and the base tray grid of holes 120 may define the plurality of receptacles. As can be appreciated, a depth of the plurality of receptacles can be defined by the depth of the first spacer grid of holes 136 in addition to the base tray holes 120. As such, the first spacer 104*a* can be implemented to increase a depth of the plurality of receptacles. By implementing the first spacer 104*a* in combination with the base tray 102 and thus increasing an effective depth of the plurality of receptacles, longer components can be placed in the receptacles while maintaining a functionality of the system 100. In one example embodiment, the first spacer 104*a* can have a thickness of approximately ⅛ inches. The depth of the holes 136 can be approximately ⅛".

Figure 4:
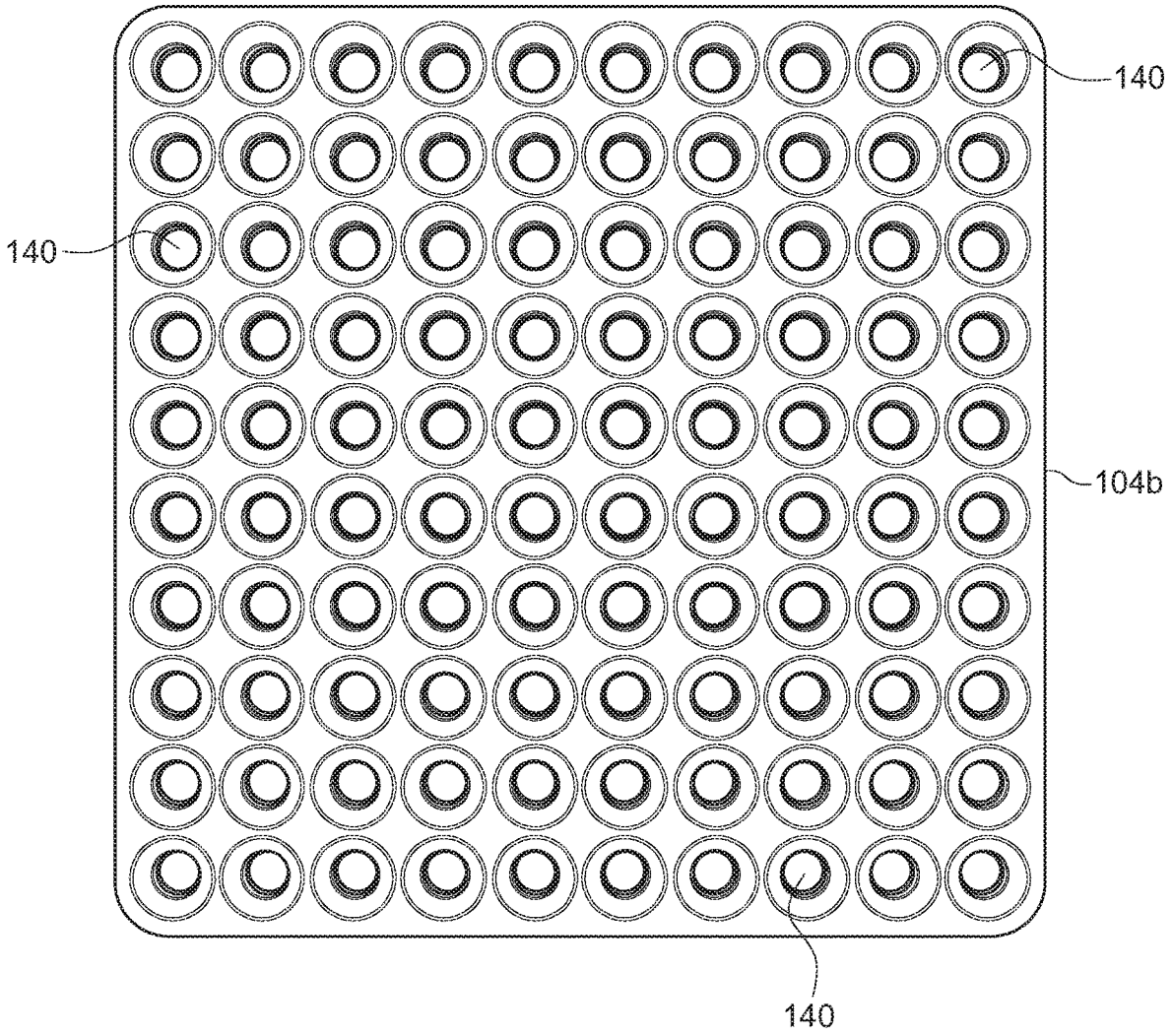
FIG. 4 is a top view of another spacer according to one embodiment of the present invention.

Referring to FIG. 4, a top view of the second spacer 104*b* is illustrated. The second spacer 104*b* can be implemented and constructed substantially similar to the previously mentioned first spacer 104*a*. The second spacer 104*b* can have a substantially square shape and can include a bottom surface, a top surface, and four sidewalls. In one example embodiment, the second spacer 104*b* can have a ¼ inch thickness.

The second spacer 104*b* can further include a grid of holes 140. The second spacer grid of holes 140 can be configured to align with the base tray grid of holes 120. For instance, a center of each of the holes 140 of the second spacer 104*b* can align with a center of a corresponding hole of the base tray holes 120. Similar to the first spacer 104*a*, a depth of the second spacer grid of holes 140 can be defined by a distance between the bottom surface and the top surface of the second spacer 104*b*. Generally, a height of the sidewalls can be approximately equal to the depth of the second spacer grid of holes 140. For instance, the depth of the holes 140 can be ¼".

The holes 140 of the second spacer 104*b* can include tapered (or beveled) openings. The holes 140 can pass through the top surface and the bottom surface of the second spacer 104*b*. Typically, the holes 140 can have a smaller opening diameter and internal diameter than the holes 136 of the first spacer 104*a* and the holes 120 of the base tray 102. In one example, the second spacer 104*b* can be implemented with components that have a smaller outside diameter than components used with the base tray 102.

Figure 5:
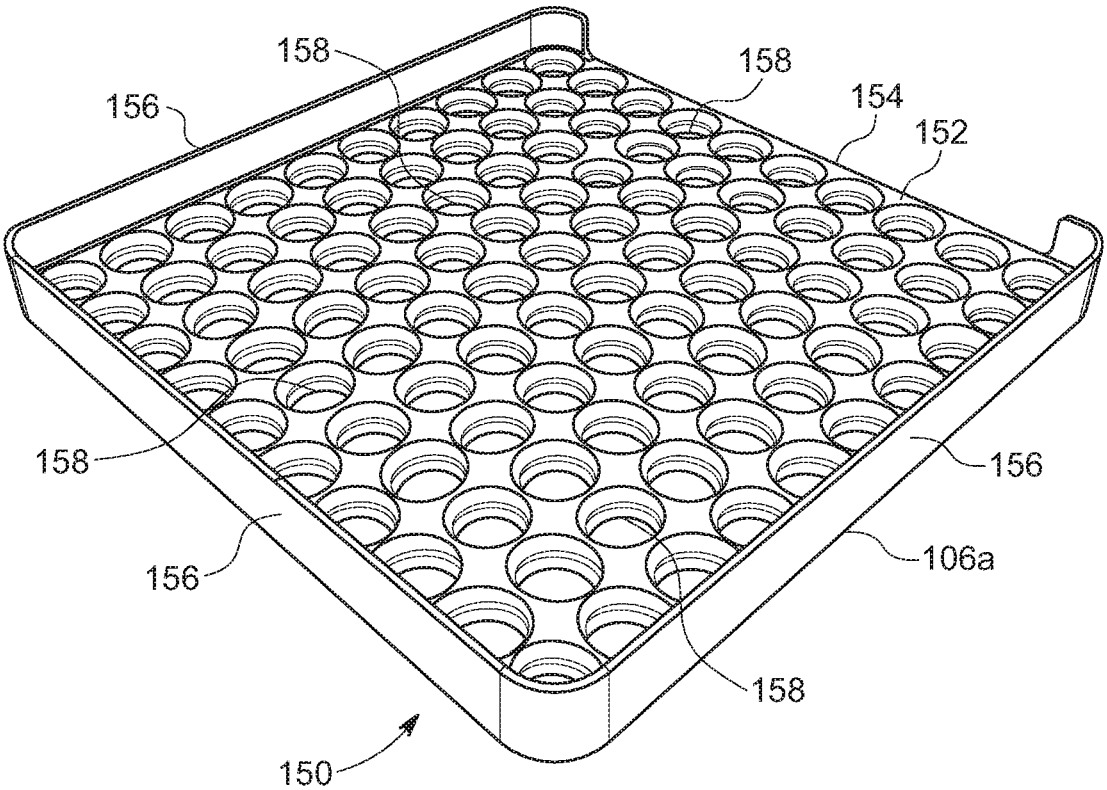
FIG. 5 is a back, perspective view of an adapter tray according to one embodiment of the present invention.

Referring to FIG. 5, a perspective view of the first adapter tray 106*a* is illustrated. As shown, the first adapter tray 106*a* can be implemented and constructed substantially similar to the base tray 102. The first adapter tray 106*a* can be sized to fit within the sidewalls 118 of the base tray 102. The first adapter tray 106*a* can be defined by a bottom surface 150, a top surface 152, a first sidewall 154, and a plurality of second sidewalls 156. The first sidewall 154 can typically extend between the bottom surface 150 and the top surface 152. The plurality of second sidewalls 156 can extend above the top surface 152 a predetermined distance. In one example embodiment, the plurality of second sidewalls 156 can extend ⅝" above the top surface 152.

The first adapter tray 106*a* can include a grid of holes 158. The grid of holes 158 can pass through the bottom surface 150 and the top surface 152 of the first adapter tray 106*a*. A depth of the grid of holes 158 can be defined by a distance between the bottom surface 150 and the top surface 152. Of note, the grid of holes 158 can pass through the bottom surface 150 creating a bore through which an ammunition component can pass through. In contrast, the bottom surface 112 of the base tray 102 can stop components deposited into the holes 120 from exiting the base tray 102 from the bottom.

Typically, the first adapter 106*a* tray can be implemented to increase a depth of the plurality of receptacles for longer ammunition components. In one example, the first adapter tray 106*a* can have an approximately ¼" thickness defined by the distance between the top surface 152 and the bottom surface 150. A depth of the holes 158 can be approximately ¼".

Figure 6:
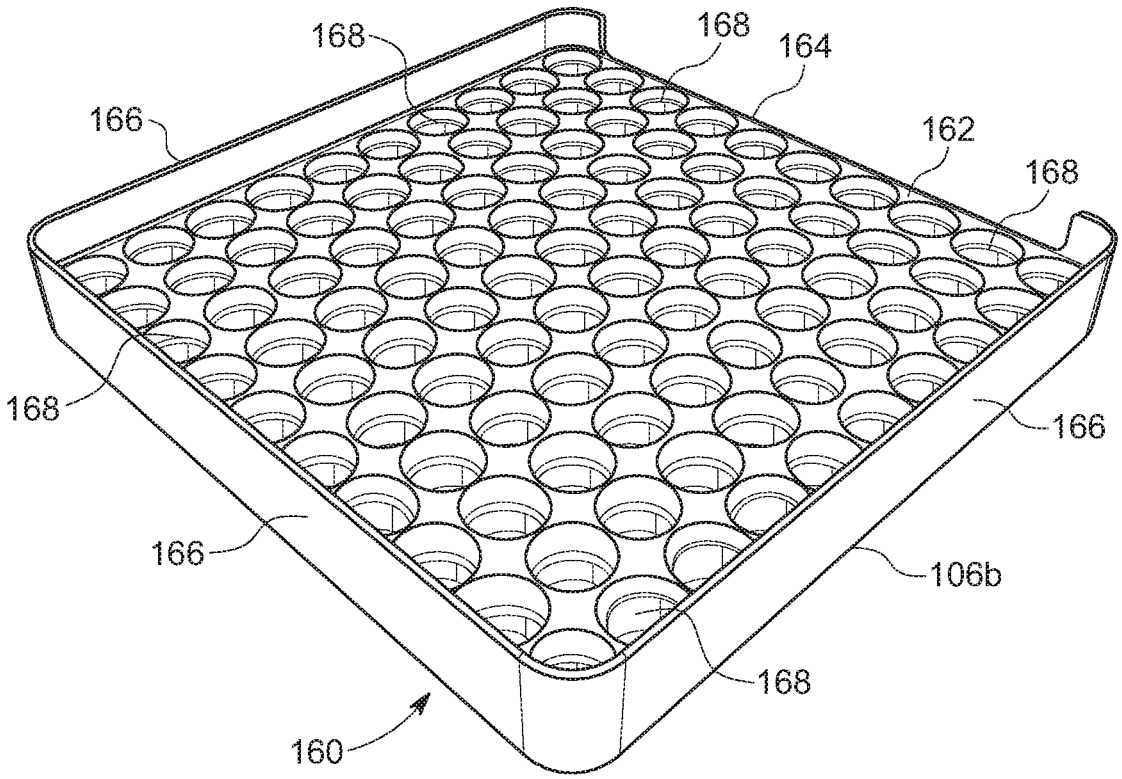
FIG. 6 is a back, perspective view of another adapter tray according to one embodiment of the present invention.

Referring to FIG. 6, a perspective view of the second adapter tray 106*b* is illustrated. As shown, the second adapter tray 106*b* can be implemented and constructed substantially similar to the base tray 102 and the first adapter tray 106*a*. The second adapter tray 106*b* can be sized to fit within the sidewalls 118 of the base tray 102. The second adapter tray 106*b* can be defined by a bottom surface 160, a top surface 162, a first sidewall 164, and a plurality of second sidewalls 166. The first sidewall 164 can typically extend between the bottom surface 160 and the top surface 162. The plurality of second sidewalls 166 can extend above the top surface 162 a predetermined distance. In one example embodiment, the plurality of second sidewalls 166 can extend ⅝" above the top surface 162.

The second adapter tray 106*b* can include a plurality of holes 168. A depth of the plurality of holes 168 can be defined by a distance between the bottom surface 160 and the top surface 162. Of note, the plurality of holes 168 can pass through the bottom surface 160 creating a bore through which an ammunition component can pass through. In contrast, the bottom surface 112 of the base tray 102 can stop components deposited into the holes 120 from exiting the base tray 102 from the bottom.

Typically, the second adapter 106*b* tray can be implemented to increase a depth of the plurality of receptacles for longer ammunition components. In one example, the second adapter tray 106*b* can have an approximately ½" thickness defined by the distance between the top surface 162 and the bottom surface 160. The depth of the plurality of holes 168 can be approximately ½".

Referring to FIG. 7, a perspective view of the base tray 102 and the baffle 110 is illustrated. As shown, the baffle 110 can fit within the sidewalls 118 of the base tray 102 or the sidewalls of the adapter trays 106*a*, 106*b*. In one embodiment, the baffle 110 can be a hand-held tool configured to act as a fourth sidewall for the trays 102, 106*a*, 106*b*. The baffle 110 can include a handle and a substantially rectangular plate having a width that is slightly less than a width of the base tray 102. The baffle 110 can be sized to fit within the adapter trays 106*a*, 106*b* as well. The baffle 110 can be sized to fit within an open side 116 of the base tray 102 and span across an entire width of the grid. In one instance, a user can move the baffle 110 forward to effectively reduce a size of the tray for purposes of counting casings. For instance, the baffle 110 can be moved forward row by row of the grid to reduce the number of holes. In one example, if the grid of holes is a 10×10 grid, a user can reduce the number of holes by 10 by moving the baffle 110 row by row. In such an instance, a user may want to count only 50 casings instead of 100. By using the baffle 110, the user can quickly limit the grid to 50 holes for quick counting. In another instance, the baffle 110 can be implemented to move ammunition components about the grid of holes. In yet another instance, the baffle 110 can be implemented to remove extra ammunition components from the base tray 102.

Figure 8:
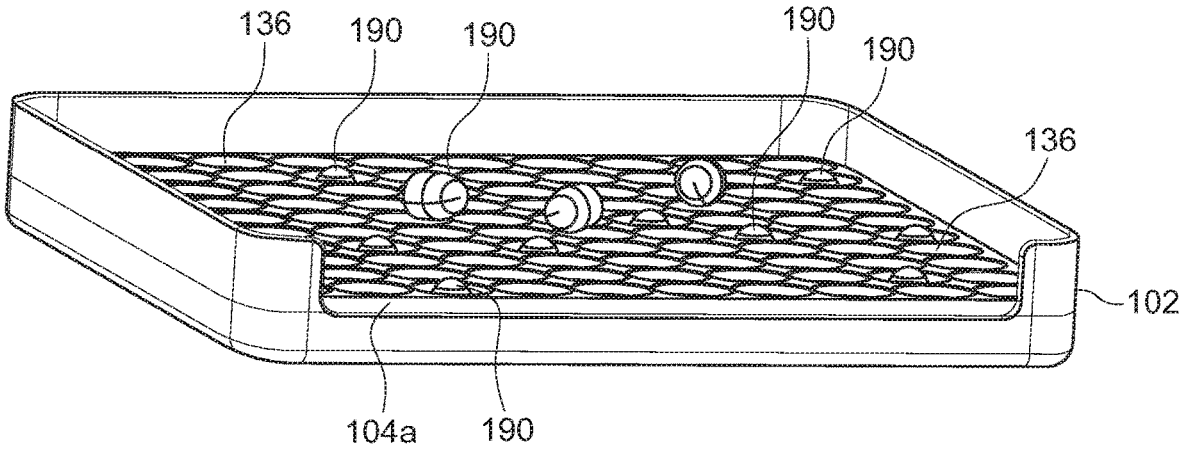
FIG. 8 is a front view of a base tray and ammunition components according to one embodiment of the present invention.

Referring to FIG. 8, a detailed diagram of the base tray 102, the first spacer 104*a*, and a plurality of ammunition components 190 is illustrated. As shown, the first spacer 104*a* can be placed within the sidewalls 118 of the base tray 102. By using the base tray 102 and the first spacer 104*a* in combination, an effective depth of the plurality of receptacles can be increased (i.e., a combination of a depth of the base tray grid of holes 120 and a depth of the first spacer grid of holes 136). The plurality of ammunition components 190 can be placed on the modular tray system 100 and the modular tray system 100 can be moved about until each of the ammunition components 190 has been deposited into one of the plurality of receptacles. Typically, when a user is moving (or agitating) the modular tray system 100, the user may place a hand or other object proximate the open side of the base tray 102 (or adapter tray) so that the ammunition components 190 do not exit the system 100. If more ammunition components 190 are deposited onto the system 100 than there are receptacles, a user may remove the excess ammunition components 190 via the open side of the system 100.

Alternative Embodiments and Variations

The various embodiments and variations thereof, illustrated in the accompanying Figures and/or described above, are merely exemplary and are not meant to limit the scope of the invention. It is to be appreciated that numerous other variations of the invention have been contemplated, as would be obvious to one of ordinary skill in the art, given the benefit of this disclosure. All variations of the invention that read upon appended claims are intended and contemplated to be within the scope of the invention.

I claim:

1. A method of implementing a modular tray system, the method comprising:

providing a modular tray system, the modular tray system including:

a first tray being defined by:

a top surface;

a bottom surface;

a first grid of holes, each of the holes having a beveled opening on the top surface; and three sidewalls extending above the top surface;

a second tray sized to fit within the three sidewalls of the first tray, the second tray being defined by:

a top surface;

a bottom surface;

a second grid of holes each having a beveled opening on the top surface and an opening on the bottom surface; and at least three sidewalls extending above the top surface of the second tray;

a plurality of receptacles for receiving ammunition components, the plurality of receptacles including at least the first grid of holes;

providing a plurality of ammunition components;

depositing the plurality of ammunition components into the modular tray system;

covering an open side of the modular tray system; and moving the modular tray system until (i) each one of the plurality of receptacles is filled with an ammunition component, or (ii) each one of the ammunition components are deposited into a receptacle.

2. The method of claim 1, wherein the ammunition components are casings.

3. The method of claim 1, wherein the ammunition components are projectiles.

4. The method of claim 1, wherein a length of the plurality of ammunition components is approximately equal to a depth of the receptacles.

5. The method of claim 1, the method further including the step of:

placing the second tray within the sidewalls of the first tray so that the second grid of holes align with the first grid of holes;

wherein the plurality of receptacles includes a combination of the first grid of holes and the second grid of holes.

6. The method of claim 1, the method further including the step of:

providing a first spacer, the first spacer being defined by:

a top surface;

a bottom surface;

a second grid of holes, each of the holes having (i) a beveled opening on the top surface and (ii) an opening on the bottom surface;

wherein the first spacer is adapted to fit within the sidewalls of the first tray.

7. The method of claim 6, the method further including the step of:

placing the first spacer inside the first tray so that the second grid of holes align with the first grid of holes;

wherein the plurality of receptacles includes a combination of the first grid of holes and the second grid of holes.

8. The method of claim 1, the method further including the step of:

removing any excess ammunition components from the modular tray system.

9. The method of claim 1, the method further including the steps of:

providing a spacer having a second grid of holes;

providing a second tray having a third grid of holes;

placing the spacer within the sidewalls of the first tray;

placing the second tray within the sidewalls of the first tray and on the spacer;

wherein the plurality of receptacles includes the first grid of holes, the second grid of holes, and the third grid of holes.

10. A method of implementing a modular tray system, the method comprising:

providing a modular tray system, the modular tray system including:

a base tray having a first grid of holes and three sidewalls that extend above the top surface of the base tray;

at least one spacer having a second grid of holes; and at least one adapter tray having a third grid of holes, the third grid of holes having an opening on a bottom surface of the at least one adapter tray;

wherein the at least one spacer and the at least one adapter tray are each sized to fit within the three sidewalls of the base tray;

determining an approximate length of an ammunition component to be counted;

selecting a configuration for the modular tray system from one of the following based on the approximate length of the ammunition component:

(i) the base tray; (ii) a combination of the base tray and the at least one spacer; (iii) a combination of the base tray and the at least one adapter tray; or (iv) a combination of the base tray, the at least one spacer, and the at least one adapter tray;

depositing a plurality of ammunition components onto the modular tray system configuration;

covering an open side of the modular tray system configuration; and moving the modular tray system configuration.

11. The method of claim 10, wherein the base tray is defined by:

a substantially square shape;

the top surface and a bottom surface;

a first sidewall extending between the bottom surface and the top surface;

and the first grid of holes having a first depth, the first depth defined by a distance between the bottom surface and the top surface.

12. The method of claim 11, wherein the at least one spacer is (i) adapted to fit within sidewalls of the base tray, and (ii) defined by:

a substantially square shape;

a top surface and a bottom surface;

four sidewalls that extend between the top surface and the bottom surface; and the second grid of holes having a second depth, the second depth defined by a distance between the bottom surface and the top surface.

13. The method of claim 12, wherein the second grid of holes align with the first grid of holes when the at least one spacer is placed within the sidewalls of the base tray.

14. The method of claim 13, wherein the approximate length of the ammunition component is about equal to the first depth plus the second depth.

15. The method of claim 11, wherein the at least one adapter tray is defined by:

a substantially square shape;

a top surface and the bottom surface;

a first sidewall extending between the bottom surface and the top surface;

three sidewalls that extend above the top surface; and the third grid of holes having a third depth, the third depth defined by a distance between the bottom surface and the top surface.

16. The method of claim 15, wherein the third grid of holes align with the first grid of holes when the at least one adapter tray is placed within the sidewalls of the base tray.

17. The method of claim 16, wherein the approximate length of the ammunition component is about equal to the first depth plus the third depth.

18. The method of claim 10, wherein (i) the first grid of holes has a first depth; (ii) a combination of the first grid of holes and the second grid of holes has a second depth; (iii) a combination of the first grid of holes and the third grid of holes has a third depth; and (iv) a combination of the first grid of holes, the second grid of holes, and the third grid of holes has a fourth depth.

19. A method of implementing a modular tray system, the method comprising:

providing a modular tray system, the modular tray system including:

a first tray being defined by (i) a top surface, (ii) a bottom surface, (iii) a first grid of holes having a first depth, each of the holes having a beveled opening on the top surface, and (iv) three sidewalls extending above the top surface;

a second tray being defined by (i) a top surface, (ii) a bottom surface, (iii) a second grid of holes having a second depth, each of the holes having a beveled opening on the top surface and an opening on the bottom surface, (iv) at least three sidewalls extending above the top surface of the second tray, (v) the second tray sized to fit within the sidewalls of the first tray; and a plurality of receptacles for receiving ammunition components, the plurality of receptacles including at least the first grid of holes;

depositing a plurality of ammunition components onto the modular tray system;

covering an open side of the modular tray system; and moving the modular tray system configuration;

wherein the second grid of holes align with the first grid of holes when the second tray is placed within the sidewalls of the first tray and the approximate length of the ammunition components is about equal to the first depth plus the second depth.

* * * * *